US010024059B2

(12) United States Patent
Mitchell et al.

(10) Patent No.: US 10,024,059 B2
(45) Date of Patent: Jul. 17, 2018

(54) AMPLIFIED METAL STUD FRAMING

(71) Applicant: BS CONCEPTS, LLC, Roanoke, TX (US)

(72) Inventors: Scott Mitchell, Roanoke, TX (US); Joseph Gambrel, Haslet, TX (US); Jason Marcum, Grapevine, TX (US); Kris Bezenek, Columbia, MO (US)

(73) Assignee: BS CONCEPTS, LLC, Roanoke, TX (US)

( * ) Notice: Subject to any disclaimer, the term of this patent is extended or adjusted under 35 U.S.C. 154(b) by 0 days.

(21) Appl. No.: 15/380,867

(22) Filed: Dec. 15, 2016

(65) Prior Publication Data

US 2018/0171634 A1 Jun. 21, 2018

(51) Int. Cl.

| | |
|---|---|
| ***E04C 3/04*** | (2006.01) |
| ***E04C 3/07*** | (2006.01) |
| ***B21D 47/01*** | (2006.01) |

(52) U.S. Cl.

CPC ..... *E04C 3/04* (2013.01); *B21D 47/01* (2013.01); *E04C 3/07* (2013.01); *E04C 2003/0421* (2013.01); *E04C 2003/0473* (2013.01)

(58) Field of Classification Search

CPC ..... E04C 3/04; E04C 3/07; E04C 2003/0421; E04C 2003/0473; E04B 2/7457; B21D 5/00; B21D 11/20; B21D 11/10

USPC ..... 29/897, 897.3, 897.31, 897.312, 897.33, 29/897.35

See application file for complete search history.

(56) References Cited

U.S. PATENT DOCUMENTS

| | | | | |
|---|---|---|---|---|
| 3,638,465 | A * | 2/1972 | Lickliter | B21D 47/01 72/181 |
| 3,689,970 | A * | 9/1972 | Falkner | B21C 37/104 29/430 |
| 3,877,275 | A * | 4/1975 | Attwood | B21B 1/09 72/177 |
| 4,018,020 | A * | 4/1977 | Sauer | E04B 2/7457 52/241 |
| 4,112,636 | A * | 9/1978 | Hays | E04F 13/0814 52/355 |
| 4,154,077 | A * | 5/1979 | Cotter | B21D 5/14 72/166 |
| 5,157,883 | A * | 10/1992 | Meyer | E04B 2/766 24/460 |
| 5,315,804 | A | 5/1994 | Attalla | |
| 5,647,186 | A | 7/1997 | Donaldson | |

(Continued)

FOREIGN PATENT DOCUMENTS

EP 0374316 B1 3/1993

OTHER PUBLICATIONS

"North American Specification for the Design of Cold-Formed Steel Structural Members," 2007 Edition, American Iron and Steel Institute, 198 pages.

*Primary Examiner* — Beth A Stephan

(74) *Attorney, Agent, or Firm* — Hahn Loeser & Parks LLP

(57) ABSTRACT

Embodiments include structural metal stud framing members with an improved web design. The structural metal stud framing member with the improved web design are referred to as an amplified metal stud member. Embodiments include a bracing structure and a stiffening structure to collectively increase the axial and lateral load capacity of the stud. In other words, embodiments increase the internal strength to weight ratio for both the overall axial and lateral load.

21 Claims, 9 Drawing Sheets

(56) References Cited

U.S. PATENT DOCUMENTS

| | | | | |
|---|---|---|---|---|
| D618,365 | S | 6/2010 | Crane | |
| D621,963 | S | 8/2010 | Zadeh | |
| D621,964 | S | 8/2010 | Zadeh | |
| 7,836,657 | B1 | 11/2010 | diGirolamo et al. | |
| 8,056,303 | B2 * | 11/2011 | Frobosilo | E04C 3/09 52/831 |
| 9,010,070 | B2 | 4/2015 | Darr, III et al. | |
| 2003/0163970 | A1 | 9/2003 | Moore et al. | |
| 2006/0144009 | A1 * | 7/2006 | Attalla | E04B 2/7457 52/831 |
| 2009/0113827 | A1 * | 5/2009 | Stone | E04C 3/07 52/846 |
| 2009/0113846 | A1 * | 5/2009 | Knauf | E04B 2/789 52/846 |
| 2014/0041232 | A1 * | 2/2014 | Smith | E04C 3/04 29/897.312 |
| 2015/0306655 | A1 * | 10/2015 | Poliquin | B24B 9/04 428/687 |

* cited by examiner

AMPLIFIED METAL STUD FRAMING

BACKGROUND

Field

Embodiments described herein relate generally to structural metal stud framing and methods for forming cold-formed metal stud framing members.

Description of the Related Art

Metal stud framed structures have become an efficient and economical alternative to wood framed structures. Along with the fact that steel is considered a "non-combustible" framing material, the advantages of metal stud framed structures over wood framed structures is the ability to increase the strength and ductility of the framing members while reducing the weight of the framing members. Cold-formed steel framing is one example of a method for forming metal stud framing members. Examples of cold-formed metal framing may include press-braking planks sheered from a sheet of metal and cold-roll forming thin steel sheets or coils. Roll forming hot-rolled sheets or coils may also be used in the production of metal stud framing members. Metal stud framing members include both structural framing members and non-structural framing members. Structural metal stud framing members are primarily designed to support vertical (or axial) loads combined with horizontal (or lateral) loads and non-structural metal stud framing members are primarily designed to support only horizontal (or lateral) loads.

Efforts to increase load capacities of a structural metal stud framing member include adding additional structures to a preformed structural metal stud framing member and/or to a metal stud framing system. By example, bracing members may be added between structural metal stud framing members within a metal stud framing system. Additionally and alternatively, web stiffeners may be added to a preformed metal stud framing member. While each metal stud framing member may be designed at a reduced weight, the added bracing members and/or web stiffening members increase the weight of the corresponding metal stud framing system.

SUMMARY

By incorporating a bracing structure and a stiffening structure into the preformed structure of a structural metal stud framing member, present embodiments are not only capable of reducing the weight of each respective structural metal stud framing member but also realize the benefits of reducing the weight of the structural metal stud framing system. This is accomplished by reducing the thickness of the sheet of metal and/or reducing the quantity of added bracing members and/or added web stiffening members within the structural metal stud framing system. Present embodiments are referred to as an amplified metal stud framing member, herein. Conventional structural metal stud framing members may include stiffening structures which extend an axial length of a metal stud framing member. These conventional stiffening structures, however, are limited to offsets formed in the web that are independently positioned across the depth of the web of a structural metal stud framing member. In contrast, present embodiments of the amplified metal stud framing member provide a web portion comprising multiple stiffening structures formed in combination with adjacent stiffening structures. Further, multiple stiffening structures are provided at various widths of the amplified metal stud framing member. In addition, multiple bracing structures are formed adjacent to and/or in combination with the multiple stiffening structures. Similarly, the multiple bracing structures may be provided at varying widths of the amplified metal stud framing member. Particular embodiments of the amplified metal stud framing member incorporate the benefits of added bracing members and added stiffening members into a single structural metal stud framing member. As a result, embodiments of the amplified metal stud framing member increase the internal strength to weight ratio for both the axial and lateral loads. Additionally, use of the embodiments additionally reduce the materials and/or components found within a structural metal stud framing system. In sum, the installation time, the weight, the spacing, and the cost of the structural metal stud framing system are reduced.

Embodiments of an amplified metal stud member include a member length extending an axial direction from a first axial end to a second axial end. A first flange and a second flange extend the member length. The first flange and the second flange are separated by a web portion and are positioned to opposite sides of a member depth. The member depth is perpendicular to the member length. The first flange and the second flange also extend a member width. The member width is perpendicular to the member length and perpendicular to the member depth.

In particular embodiments, the web portion includes at least two bracing structures and at least two stiffening structures formed therein. The at least two bracing structures and the at least two stiffening structures also extend the member length. The at least two bracing structure have a linear surface parallel to the member depth. The at least two stiffening structures have a linear surface oblique to the member depth and the member width.

In some embodiments the amplified metal stud member may have a web portion that includes a first web portion and a second web portion. The first web portion extends from and is perpendicular to the first flange. The second web portion extends from and is perpendicular to the second flange. A transitioning structure may transition each web portion to a respective flange.

In these embodiments the web portion may also include a first bracing structure, a second bracing structure, and a third bracing structure. The first bracing structure is parallel to the first and second web portions and separated from the first web portion by a first stiffening structure. The third bracing structure is parallel to the first and second web portions and separated from the second web portion by a fourth stiffening structure. The second bracing structure is also parallel to the first and second web portions and separated from the first and third bracing structures by a second stiffening structure and a third stiffening structure, respectively. A transitioning structure may be provided between each respective structure and transition between each respective structure and web portion.

Embodiments also include a method for forming an amplified metal stud member. The method includes providing a sheet of metal in a coiled configuration. The sheet of metal may be unwound into a flat sheet. The flat sheet is then fed into a forming apparatus. The forming apparatus includes one or more tooling stands. The forming apparatus forms the flat sheet into an amplified metal stud member having the various profiles disclosed herein. The method may further include cutting the amplified metal stud member into the member length.

The foregoing and other objects, features and advantages of the embodiments will be apparent from the following more detailed descriptions of particular embodiments, as illustrated in the accompanying drawings wherein like reference numbers represent like parts of the embodiments.

BRIEF DESCRIPTION OF THE DRAWINGS

Reference is made to the accompanying drawings in which particular embodiments and further benefits of the embodiments are illustrated as described in more detail in the description below, in which.

DETAILED DESCRIPTION OF PARTICULAR EMBODIMENTS

Figure 1:
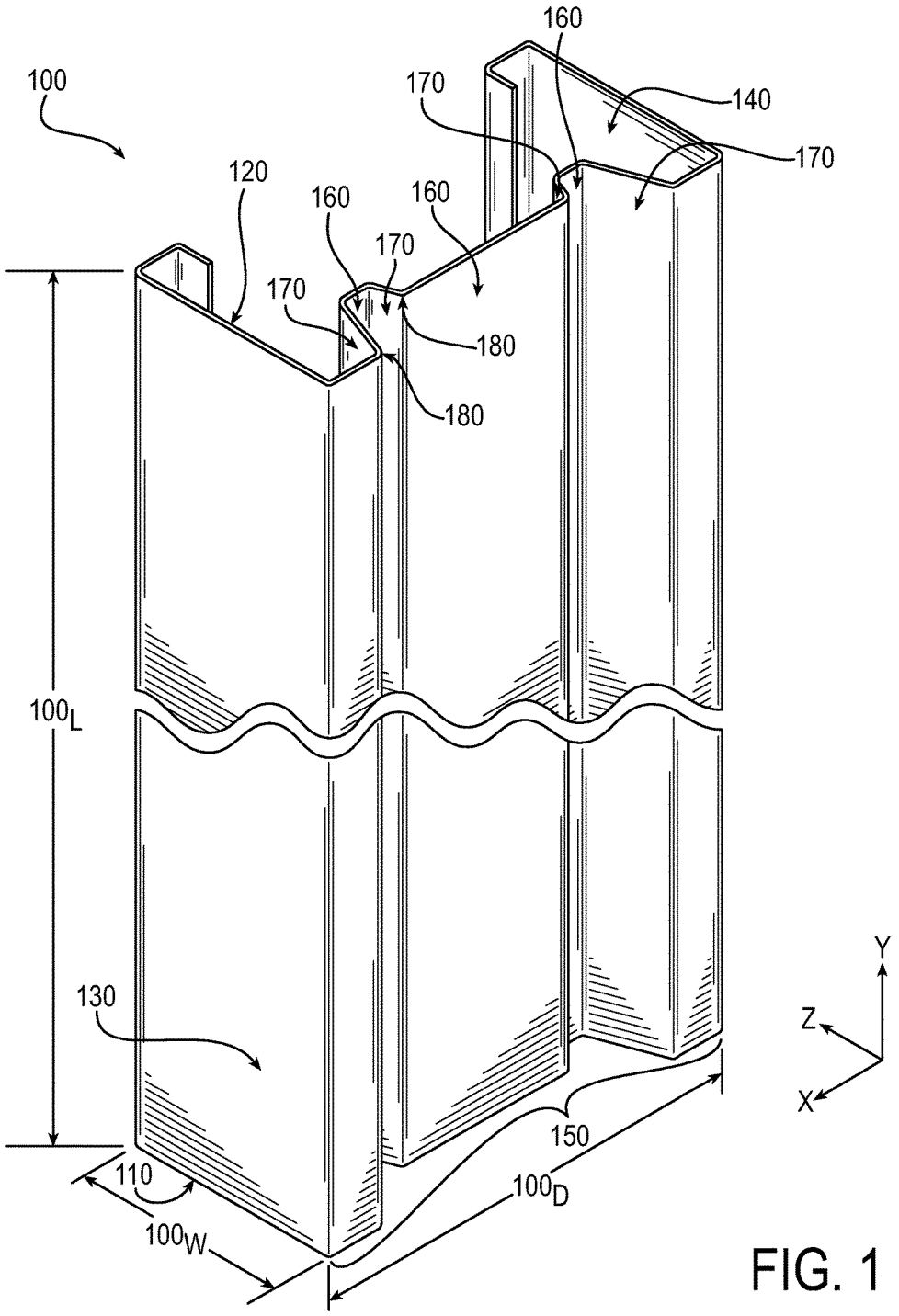
FIG. 1 is an isometric view of an amplified metal stud member, in accordance with an embodiment.

Present embodiments include structural metal stud framing members having a new web configuration. The structural metal stud framing members with the new web configuration are referred to as amplified metal stud members, herein. The improved web design includes preformed and integral bracing structures and stiffening structures. The combination of the bracing structures and the stiffening structures increases both the axial (i.e. vertical) load capacity and the lateral (i.e. horizontal) load capacity, in combination. In embodiments, the position of the internal bracing structures and the internal stiffening structures are configured to move the shear center of the amplified metal stud member in close proximity to the geometric centroid, positioned on a plane extending in the lateral direction of the amplified metal stud member.

Amplified metal stud members are a breakthrough in the load bearing steel stud industry, producing significant increases in load capacity when compared with conventional C-shaped metal stud framing members. Amplified metal stud members' unique configuration provides installation and design advantages which create efficiencies no other light steel framing (LSF) load bearing wall stud provides. The orientation of each stiffening structure, each bracing structure, and each bend of an amplified metal stud member increases load capacity over a standard stud section with the same material thickness. In some embodiments, the lip configuration of the flange portion further increases the advantages when made in combination with the web portion of the amplified metal stud members, delivering the most efficient LSF load-bearing stud member available. Amplified metal stud members redefine previous limitations considered for utilization of steel studs in building construction, producing more costs-efficient options for designing load bearing walls.

Axial (i.e. vertical) forces exerted on a structural metal stud framing member may cause web buckling. Web buckling is the failure of the entire structural metal stud framing member due to the compression exhibited by the axial (i.e. vertical) forces exerted on the axial length of the structural metal stud framing member. Both the Allowable Strength Design (ASD) and Load Resistance Factor Design (LRFD), as recognized by the American Institute of Steel Construction (AISC), incorporate these loads into the design of a structural metal stud framing member. Stiffeners may be incorporated into the design of a structural metal stud framing member to increase the axial load capacity of the member. Generally, the stiffeners are limited to a single structure formed in the web of a conventional structural metal stud framing member. Multiple stiffeners may also be provided, however, the multiple stiffeners are independently formed. Finally, separately formed stiffening members may be added to or attached to a preformed conventional metal stud framing member to increase the strength of the web portion and/or flange portion.

Lateral (i.e. horizontal) forces exerted on a structural metal stud framing member may cause web crippling. Web crippling is the failure of the web portion and/or the flange portion(s) of a structural metal stud framing member. The failure is a result of compression in a lateral (i.e. horizontal) direction, relative an upright structural metal stud framing member with the axial length in a vertical direction. Failures are most often experienced at point loads, such as bearing seats, where a localized force is encountered. Since the greatest risk for web crippling occurs under a localized force, the accepted design criteria incorporates independent reinforcement structures at the anticipated location of the localized forces. The independent reinforcement structures may include providing an independent stiffening track positioned or fastened within the structural metal stud framing member at or near the location of the localized force. Also, as described above, independent bracing members may be provided to tie adjacent structural metal stud framing members together into a metal stud framing system. There, however, is a need to increase the lateral load capacity along the entire length of a structural metal stud framing member, not simply at the anticipated location of a localized force.

Present embodiments of the amplified metal stud member are an improvement to, and distinguished from, the current independently formed stiffening members. In particular, embodiments of the amplified metal stud member combine multiple preformed stiffening structures with multiple preformed bracing structures into a preformed web portion. Specifically, adjacent preformed stiffening structure are combined with adjacent preformed bracing structures across the web portion. As a result, the web portion includes multiple structures formed at multiple widths of the amplified metal stud member. Moreover, the web portion includes a combination of stiffening structures and/or bracing structures formed in the web portion of the metal stud framing member. Embodiments of the amplified metal stud member will illustrate how these preformed stiffening structures and bracing structures achieve increased axial and lateral load capacities while reducing the addition of independent reinforcement members.

In embodiments, the amplified stud member has a member length, member depth, and a member width. The member length extends in an axial direction from a first axial end to a second axial end of the member. A first flange and a second flange also extend the axial length. The first flange and the second flange are separated by the web portion where the first flange and the second flange are positioned on opposing sides of a member depth. The member depth is perpendicular to the member length. In some embodiments the web portion is formed from a single sheet of metal. The first flange and the second flange extend a member depth. The member depth is perpendicular to the member length and perpendicular to the member depth.

The web portion comprises at least two bracing structures and at least two stiffening structures. The at least two bracing structures and the at least two stiffening structures additionally extend the member length. The at least two bracing structures each have a linear surface parallel to the member depth. Therefore, each surface of the at least two bracing structures are perpendicular to the member width. In contrast, the at least two stiffening structures have a linear surface oblique to the member depth and oblique to the member width. Embodiments may include at least three bracing structures, at least four bracing structures, or any number of bracing structures. Similarly, embodiments may include at least three stiffening structures, at least four stiffening structures, or any number of stiffening structures. In various embodiments, the quantity of stiffening structures equals the quantity of bracing structures. In other embodiments, the quantity of stiffening structures may be more than or may be less than the quantity of bracing structure.

In embodiments, the orientation, the quantity, and/or the location of each of the at least two bracing structures are coordinated with each of the at least two stiffening structures. In various embodiments, the at least two bracing structures alternate with each of the two stiffening structures, across a member depth. In some embodiments, the web portion is symmetrical, relative a centerline of the member depth of the web portion. In particular embodiments, the entire amplified metal stud member is symmetrical across the centerline of the member depth, including the at least first flange and the at least second flange.

The web portion may also advance in a direction relative the member depth. In various embodiments, a combination of the at least two bracing structures and the at least two stiffening structures advance the web portion to an intersection of the centerline of the member depth and a centerline of the member width. In other embodiments, a combination of the at least two bracing structures and the at least two stiffening structures may advance the web portion in a direction away from the intersection of the centerline of the member depth and the centerline of the member width. In yet another embodiment, a combination of the at least two bracing structures and the at least two stiffening structures may advance the web portion through the intersection of the centerline of the member depth and the centerline of the member width, thereby, providing segments of the web portion to each side of this intersection, relative both the member depth and the member width.

In various embodiments, such as the embodiments where the web portion advances relative the intersection of the centerline of the member depth and the centerline of the member width, a member shear center of the amplified metal stud member may be advanced toward, or be at, a geometric centroid. In some embodiments, the member shear center is proximal the geometric centroid. As used with respect to these embodiments, proximal is within 1.644 inches. The shear center, which may also be known as the elastic axis or torsional axis, is a point on a two-dimensional lateral plane which bisects the axial direction of an amplified metal stud member, such that the plane extends the member depth and the member width. The shear center is the location where a shear force is applied without inducing any torsion on the amplified metal stud member. It is appreciated that in conventional structural metal stud framing members, the shear center is not the geometric centroid. The geometric centroid is also a point on the two-dimensional lateral plane as defined above. The geometric centroid, however, is the point where the profile or mass of the structural metal stud member would be balanced on the lateral plane if it were placed on a needle. In other words, the geometric centroid is its geometric center where its center of gravity is located, relative the defined lateral plane. In particular embodiments, the at least two stiffening structures and the at least two bracing structures are configured on the web portion to orientate the member shear center at the geometric centroid or proximal the geometric centroid.

A transitioning structure may be provided between each structure of the web portion, between the web portion and each flange, between a structure at each flange, and/or any combination thereof. In a particular embodiment, a transitioning structure is positioned between the first flange and the web portion and the second flange and the web portion. Further, the transitioning structure may be positioned and connect each of the at least two bracing structures and each of the two stiffening structures of the web portion. The transition structures may also be formed from the metal plate forming the amplified metal stud member. In some embodiments, the transitioning structure is a radius where an axis of the radius extends the member length. In other embodiments, the transitioning structure may be an angle, where a vertex of the angle extends the member length. Various embodiments may include acute angles, obtuse angles, right angles, or a combination of angles. In yet other embodiments, the transitioning structure may be an angle, different angles, a radius, different radii, and/or a combination thereof, extending discontinuous the member length.

In particular embodiments, each bracing structure of the at least two bracing structures is oriented relative another bracing structure of the at least two bracing structures. Similarly, each stiffening structure of the at least two stiffening structures may be oriented relative another stiffening structure of the at least two stiffening structures. In some embodiments, two of the at least two bracing structure are coplanar. In yet other embodiments, at least two pair of bracing structures may be provided where each bracing structure of each pair of the at least two pair of bracing structures are coplanar. In some embodiments, two of the at least two stiffening structures are inverse one another relative the centerline of the member depth or relative another point on the member depth. It is further contemplated an embodiment includes any combination of the above.

Embodiments provide an amplified metal stud member with an increased internal strength to weight ratio for axial and lateral loads. The internal design reduces the need to incorporate additional materials and the additional installation effort required to construct the structural metal stud framing systems, including constructing built-up column sections, adding bracing members, adding reinforcement structures (such as independent stiffening tracks), or the like. It is, however, contemplated that a structural metal stud framing system may be constructed using embodiments of the amplified metal stud member to further increase axial and/or vertical load capacities. In these instances, the number of amplified metal stud members and these independent structures may be collectively reduced in the structural metal stud framing system.

The increased axial and lateral strength to weight ratio of embodiments also allows the amplified metal stud member spacing, or the distance between each adjacent metal stud framing member, to be increased. By increasing the spacing, the quantity of metal stud framing members, within a metal stud framing system, is reduced. As a result, the weight of the structural metal stud framing system is reduced, thereby reducing the expense and effort required for installation of the entire system. Additional advantages include increased tolerances and/or access for the installation of mechanical, electrical, and plumbing components. This further reduces design conflicts and design changes with the mechanical, electrical, and plumbing components. Ultimately, accessibility is increased before and after installation of the components.

An increased strength to weigh ratio for both axial and lateral loads also allows a reduction in the thickness of the material utilized in the embodiments. By reducing the thickness of the material, fasteners penetrate the material in an expedited manner with more ease. Thereby, installation time and cost of the fasteners, themselves, is reduced.

Embodiments of the amplified metal stud member also reduces the effect of unintended seating of a structural metal stud member within a metal stud track. In structural metal stud framing systems, the material used at the metal stud track is constructed of sheet steel with at least the same thickness as the amplified metal stud member. An increase in sheet steel gauge results in a larger inside radius at bends formed within the metal stud track. With an increased bend radius, it is more difficult to fully seat the metal stud flanges into the metal stud track. Moreover, with a more balanced shear center, as provided in embodiments of the web profile of the amplified metal stud member, the amplified metal stud member will have more centralized contact and balance within each of the metal stud tracks. As a result, loads are more evenly distributed and the amplified metal stud member will maintain an upright position even before being fastened or supported within the metal stud track, further increasing the ease of installation. In embodiments, it is appreciated that an identified uncoated steel thickness of a cold-formed steel product includes thicknesses within 95% of the identified thickness. Further, decreased thicknesses, greater than 95%, may be exhibited and are contemplated at bends, such as corners, due to cold-forming effects.

Details of particular embodiments of the amplified metal stud members are provided below. Test data is further provided to illustrate the advantages of the amplified metal stud members. In one particular embodiment, the amplified metal stud member is produced for a 6 inch wall. It is appreciated, however, the same design may be incorporated into larger or smaller wall designs. The nomenclature for a 6 inch wall design of an amplified metal stud member is 600AS300-33 and is defined as follows. In this example, the member web depth is 600, taken in 1/100 inch; The member web style is illustrated by AS, which stands for Amplified Stud; The member flange width is 300, taken in 1/100 inch; and the mil thickness is 33, which is the minimum base steel thickness in mils. In the examples of these particular embodiments, the material properties of the amplified metal stud member are ASTM A1003/A1003M or ASTM A653/A653M, Grade 50(34), 50 ksi (340M Pa) minimum yield strength, 65 ksi (450 M Pa) minimum tensile strength, and G-60 (Z180) hot-dipped galvanized coating, or an equivalent of these properties.

Using the nomenclature identified above, several examples of an amplified metal stud member are provided in the tables below. Table I illustrates geometric properties (each provided in inches (in), unless otherwise indicated) of various embodiments of amplified metal stud members, corresponding to the Figures. Table II through Table IV illustrate section properties of various embodiments of amplified metal stud members. Definitions for each section property is provided following the tables.

TABLE I

Amplified Metal Stud Geometric Properties

| Section | Member Depth $100_D$ | Member Width $100_W$ | Web Depth $151_D$, $152_D$ | Bracing Depth $161_D$, $163_D$ | Stiffener Width $171_W$, $174_W$ | Stiffener Width $172_W$, $173_W$ | Bracing Depth $162_D$ | Flange lip 220 | Flange lip 230 | Radius $180_R$ |
|---|---|---|---|---|---|---|---|---|---|---|
| 600AS300-33 | 6 | 3 | 0.833 | 0.388 | 1 | 0.375 | 0.372 | 0.750 | 0.5 | 0.085 |
| 600AS30-43 | 6 | 3 | 0.833 | 0.388 | 1 | 0.375 | 0.372 | 0.750 | 0.5 | 0.085 |
| 600AS300-54 | 6 | 3 | 0.833 | 0.388 | 1 | 0.375 | 0.372 | 0.750 | 0.5 | 0.085 |
| 600AS300-68 | 6 | 3 | 0.833 | 0.388 | 1 | 0.375 | 0.372 | 0.750 | 0.5 | 0.085 |

TABLE II

Amplified Metal Stud Section Properties
Gross Properties

| Section | Design Thickness (in), $200_T$ | $F_y$ (ksi) | Area ($in^2$) | Weight (pound per foot (lb/ft)) | $I_x$ ($in^4$) | $S_x$ ($in^3$) | $R_x$ (in) | $I_y$ ($in^4$) | $R_y$ (in) |
|---|---|---|---|---|---|---|---|---|---|
| 600AS300-33 | 0.0346 | 33 | 0.541 | 1.839 | 3.067 | 1.022 | 2.38 | 0.511 | 0.972 |
| 600AS300-43 | 0.0451 | 33 | 0.704 | 2.393 | 3.977 | 1.325 | 2.377 | 0.664 | 0.971 |
| 600AS300-43 | 0.0451 | 50 | 0.704 | 2.393 | 3.977 | 1.325 | 2.377 | 0.664 | 0.971 |
| 600AS300-54 | 0.0451 | 50 | 0.881 | 2.997 | 4.963 | 1.654 | 2.372 | 0.83 | 0.97 |
| 600AS300-68 | 0.0713 | 50 | 1.101 | 3.745 | 6.171 | 2.056 | 2.367 | 1.03 | 0.966 |

TABLE III

Amplified Metal Stud Section Properties
Effective Properties

| Section | Design Thickness (in), $200_T$ | $F_y$ (ksi) | $I_{xe}$ ($in^4$) | $S_{xe}$ ($in^3$) |
|---|---|---|---|---|
| 600AS300-33 | 0.0346 | 33 | 3.057 | 1.018 |
| 600AS300-43 | 0.0451 | 33 | 3.964 | 1.321 |
| 600AS300-43 | 0.0451 | 50 | 3.964 | 1.321 |

TABLE III-continued

| Amplified Metal Stud Section Properties Effective Properties | | | | |
|---|---|---|---|---|
| Section | Design Thickness (in), $200_T$ | $F_y$ (ksi) | $I_{xe}$ ($in^4$) | $S_{xe}$ ($in^3$) |
| 600AS300-54 | 0.0451 | 50 | 4.947 | 1.648 |
| 600AS300-68 | 0.0713 | 50 | 6.151 | 2.049 |

TABLE IV

| Amplified Metal Stud Section Properties Torsional Properties | | | | | | | |
|---|---|---|---|---|---|---|---|
| Section | Design Thickness (in), $200_T$ | $F_y$ (ksi) | $Jx10^3$ ($in^4$) | $C_w$ ($in^6$) | $X_o$ (in) | $R_o$ (in) | β |
| 600AS300-33 | 0.0346 | 33 | 0.215 | 5.526 | 1.644 | 3.052 | 0.709 |
| 600AS300-43 | 0.0451 | 33 | 0.477 | 7.153 | 1.643 | 3.048 | 0.709 |
| 600AS300-43 | 0.0451 | 50 | 0.477 | 7.153 | 1.643 | 3.048 | 0.709 |
| 600AS300-54 | 0.0451 | 50 | 0.941 | 8.908 | 1.641 | 3.044 | 0.709 |
| 600AS300-68 | 0.0713 | 50 | 1.867 | 10.97 | 1.635 | 3.035 | 0.709 |

Gross properties are defined as follows:

$I_x$: Moment of inertia of the cross section about the X-axis.

$S_x$: Section modulus about the X-axis.

$R_x$: Radius of gyration of cross section about the X-axis.

$I_y$: Moment of inertia of cross section about the Y-axis.

$R_y$: Radius of gyration of cross section about the Y-axis.

Effective properties are defined as follows:

$I_{xe}$: Effective moment of inertia about the X-axis.

$S_{xe}$: Effective section modulus about the X-axis.

Torsional and other properties are defined as follows:

J: St. Venant torsional constant. The numbers showing in the tables for 'J' have been multiplied by 1,000. The actual values can be obtained by dividing the listed numbers by 1,000.

$C_w$: Torsional warping constant.

$X_o$: Distance from shear center to the centroid along the principal X-axis.

$R_o$: Polar radius of gyration of cross section about the shear center.

β: $1-(X_o/R_o)^2$.

Still using the nomenclature identified above, the examples of the amplified metal stud member are further illustrated in corresponding Combined Axial & Load Tables, Table V through Table IX, for constructing a wall having a wall height measured in feet (ft), equal to the member length, and with the amplified metal stud members spaced at 12 inches, 16 inches, or 18 inches within a framing system. In the examples illustrated by the tables, the following characteristics and/or considerations have been included. The allowable loads are based on weak axis and torsional bracing at 48 inches on center (o.c.) maximum for axial load calculation and continuous support of each flange for flexural calculation. In these examples, sections are punched with a standard punch-out that is 1.5 inches wide located along the centerline of the member depth and 24 inches o.c. the member length. The allowable loads are based on checks for punched section under axial load, flexural, and shear conditions. The weak axis and torsional bracing shown have sufficient stiffness and strength to resist the axial load. The allowable axial strength for distortional buckling is based on the assumed K=0. Lateral loads have not been modified for strength checks: full loads are applied. Listed wind pressures represent calculated design wind pressure (1.0 W based on 2009 or 0.6 W based on 2011 IBC). 15 psf and higher wind pressure have been multiplied by 0.7 for deflection determination, in accordance with footnotes "f" on IBC table 1604.3. The 5 psf pressure has not been reduced for deflection calculations. Strength increase due to cold forming is incorporated in calculating allowable loads as per AISI Specification Section A7.2. The moment of inertia for deflection is optimized based on the maximum moment at service loads for the listed spans, therefore, span values may be greater than spans based on an effective moment of inertia listed in section property tables. Loads in the tables are in kips/stud (1 kip=1,000 pounds (lbs)).

TABLE V

| 600AS300-33 (33 kis) Loads 600AS300-33 (33 ksi) | | | | | | | | | | | | | | | |
|---|---|---|---|---|---|---|---|---|---|---|---|---|---|---|---|
| Wall Height | 5 psf | | | 20 psf | | | 25 psf | | | 30 psf | | | 40 psf | | |
| (ft) | 12 in | 16 in | 24 in | 12 in | 16 in | 24 in | 12 in | 16 in | 24 in | 12 in | 16 in | 24 in | 12 in | 16 in | 24 in |
| 8 | 5.215 | 5.1 | 5 | 4.575 | 4.3 | 3.765 | 4.37 | 4.03 | 3.375 | 4.165 | 3.765 | 2.99 | 3.765 | 3.245 | 2.235 |
| 10 | 4.815 | 4.705 | 4.485 | 3.86 | 3.46 | 2.685 | 3.557 | 3.065 | 2.125 | 3.26 | 2.685 | 1.585 | 2.685 | 1.945 | 0.545 |
| 12 | 4.37 | 4.215 | 3.917 | 3.075 | 2.55 | 1.56 | 2.677 | 2.045 | 0.865 | 2.293 | 1.56 | 0.203 [5] | 1.56 | 0.64 | — |
| 14 | 4.265 | 4.045 | 3.63 | 2.495 | 1.81 | 0.555 [5] | 1.975 | 1.165 | — | 1.48 | 0.555 [5] | — | 0.555 [5] | — | — |
| 16 | 4.13 | 3.465 | 2.97 | 1.67 | 0.915 [5] | — | 1.097 [5] | 0.217 [4] | — | 0.56 [4] | — | — | — | — | — |

[1] Deflection exceeds L/120
[2] Deflection exceeds L/240
[3] Deflection exceeds L/360
[4] Deflection exceeds L/600
[5] Deflection exceeds L/720

TABLE VI

600AS300-43 (33 ksi) Loads
600AS300-33 (33 ksi)

| Wall Height | 5 psf | | | 20 psf | | | 25 psf | | | 30 psf | | | 40 psf | | |
|---|---|---|---|---|---|---|---|---|---|---|---|---|---|---|---|
| (ft) | 12 in | 16 in | 24 in | 12 in | 16 in | 24 in | 12 in | 16 in | 24 in | 12 in | 16 in | 24 in | 12 in | 16 in | 24 in |
| 8 | 8.125 | 8.06 | 7.935 | 7.555 | 7.305 | 6.81 | 7.37 | 7.055 | 6.44 | 7.18 | 6.81 | 6.075 | 6.81 | 6.32 | 5.355 |
| 10 | 7.72 | 6.34 | 5.59 | 6.72 | 6.34 | 5.59 | 6.43 | 5.96 | 5.05 | 6.15 | 5.59 | 4.515 | 5.59 | 4.87 | 3.48 [5] |
| 12 | 7.015 | 6.87 | 6.59 | 5.77 | 5.25 | 4.26 | 5.38 | 4.75 | 3.55 | 5 | 4.26 | 2.875 | 4.26 | 3.32 | 1.59 [4] |
| 14 | 6.38 | 6.19 | 5.815 | 4.865 | 4.125 | 2.93 | 4.28 | 3.515 | 2.105 [5] | 3.815 | 2.93 | 1.33 [5] | 2.93 | 1.84 [5] | — |
| 16 | 5.715 | 5.475 | 5.01 | 3.775 | 3.04 | 1.72 [4] | 3.22 | 2.36 [5] | 0.825 [4] | 2.695 | 1.72 [4] | — | 1.72 [4] | 0.545 [4] | — |

[1] Deflection exceeds L/120
[2] Deflection exceeds L/240
[3] Deflection exceeds L/360
[4] Deflection exceeds L/600
[5] Deflection exceeds L/720

TABLE VII

600AS300-43 (50 ksi) Loads
600AS300-33 (33 ksi)

| Wall Height | 5 psf | | | 20 psf | | | 25 psf | | | 30 psf | | |
|---|---|---|---|---|---|---|---|---|---|---|---|---|
| (ft) | 12 in | 16 in | 24 in | 12 in | 16 in | 24 in | 12 in | 16 in | 24 in | 12 in | 16 in | 24 in |
| 8 | 11.03 | 10.96 | 10.81 | 10.34 | 10.04 | 9.44 | 10.12 | 9.74 | 9.01 | 9.89 | 9.52 | 8.59 |
| 10 | 10.18 | 10.05 | 9.81 | 9.11 | 8.66 | 7.795 | 8.77 | 8.23 | 7.17 | 8.44 | 7.795 | 6.55 |
| 12 | 9.22 | 9.05 | 8.71 | 7.75 | 7.15 | 6.01 | 7.3 | 6.57 | 5.21 | 6.86 | 6.01 | 4.445 |
| 14 | 8.21 | 7.98 | 7.54 | 6.34 | 5.61 | 4.285 | 5.79 | 4.93 | 3.375 [5] | 5.265 | 4.285 | 2.52 [5] |
| 16 | 7.18 | 6.895 | 6.37 | 4.99 | 4.185 | 2.76 [4] | 4.38 | 3.45 [5] | 1.81[4] | 3.81 | 2.76 [4] | 0.93 [4] |

| Wall Height | 40 psf | | |
|---|---|---|---|
| (ft) | 12 in | 16 in | 24 in |
| 8 | 9.44 | 8.87 | 7.75 |
| 10 | 7.795 | 6.96 | 5.37 |
| 12 | 6.01 | 4.95 | 3.005 [5] |
| 14 | 4.285 | 3.085 [5] | 0.955 [4] |
| 16 | 2.76 [4] | 1.51 [4] | — |

[1] Deflection exceeds L/120
[2] Deflection exceeds L/240
[3] Deflection exceeds L/360
[4] Deflection exceeds L/600
[5] Deflection exceeds L/720

TABLE VIII

600AS300-54 (50 ksi) Loads
600AS300-33 (33 ksi)

| Wall Height | 5 psf | | | 20 psf | | | 25 psf | | | 30 psf | | | 40 psf | | |
|---|---|---|---|---|---|---|---|---|---|---|---|---|---|---|---|
| (ft) | 12 in | 16 in | 24 in | 12 in | 16 in | 24 in | 12 in | 16 in | 24 in | 12 in | 16 in | 24 in | 12 in | 16 in | 24 in |
| 8 | 14.66 | 14.6 | 14.48 | 14.1 | 13.85 | 13.37 | 13.92 | 13.61 | 13 | 13.85 | 13.36 | 12.64 | 13.37 | 12.88 | 11.92 |
| 10 | 13.64 | 13.54 | 13.34 | 12.75 | 12.36 | 11.61 | 12.46 | 11.98 | 11.05 | 12.17 | 11.6 | 10.51 | 11.61 | 10.87 | 9.45 |
| 12 | 13.2 | 13.06 | 12.78 | 11.97 | 11.45 | 10.42 | 11.57 | 10.93 | 9.67 | 11.19 | 10.42 | 8.94 | 10.42 | 9.43 | 7.54 |
| 14 | 11.22 | 11.02 | 10.63 | 9.53 | 8.85 | 7.6 | 9.02 | 8.21 | 6.74 | 8.53 | 7.6 | 5.92 [4] | 7.6 | 6.46 | 4.41 [4] |
| 16 | 9.92 | 9.66 | 9.17 | 7.87 | 7.1 | 5.72 [5] | 7.285 | 6.39 | 4.79 [4] | 6.735 | 5.72 [5] | 3.93 [4] | 5.72 [5] | 4.495 [4] | 2.355 [3] |

[1] Deflection exceeds L/120
[2] Deflection exceeds L/240
[3] Deflection exceeds L/360
4 Deflection exceeds L/600
[5] Deflection exceeds L/720

TABLE IX

| 600AS300-68 (50 ksi) Loads<br>600AS300-33 (33 ksi) | | | | | | | | | | | | | | | |
|---|---|---|---|---|---|---|---|---|---|---|---|---|---|---|---|
| Wall Height | 5 psf | | | 20 psf | | | 25 psf | | | 30 psf | | | 40 psf | | |
| (ft) | 12 in | 16 in | 24 in | 12 in | 16 in | 24 in | 12 in | 16 in | 24 in | 12 in | 16 in | 24 in | 12 in | 16 in | 24 in |
| 8 | 19.48 | 19.42 | 19.3 | 18.92 | 18.68 | 18.19 | 18.74 | 18.43 | 17.82 | 18.55 | 18.18 | 17.45 | 18.18 | 17.69 | 16.73 |
| 10 | 18.15 | 18.05 | 17.85 | 17.25 | 16.86 | 16.09 | 16.95 | 16.47 | 15.52 | 16.66 | 16.09 | 14.96 | 16.09 | 15.33 | 13.88 |
| 12 | 16.63 | 16.48 | 16.18 | 15.31 | 14.76 | 13.7 | 14.9 | 14.22 | 12.93 | 14.49 | 13.69 | 12.18 | 13.69 | 12.7 | 10.78 |
| 14 | 14.97 | 14.77 | 14.35 | 13.21 | 12.5 | 11.18 | 12.67 | 11.83 | 10.25 | 12.16 | 11.18 | 9.38 | 11.18 | 9.96 | 7.76 [4] |
| 16 | 13.18 | 12.91 | 12.4 | 11.03 | 10.21 | 8.74 | 10.19 | 9.45 | 7.74 [5] | 9.83 | 8.74 | 6.8 [4] | 8.74 | 7.42 [5] | 5.1 [4] |

[1] Deflection exceeds L/120
[2] Deflection exceeds L/240
[3] Deflection exceeds L/360
[4] Deflection exceeds L/600
[5] Deflection exceeds L/720

Embodiments also include methods for forming an amplified metal stud member. The method includes the step of providing a sheet of metal. The metal may be steel. The sheet of metal may be provided in a coiled configuration. If coiled, a step of unwinding the sheet of metal occurs prior to a step of placing the sheet of metal into a forming apparatus. In various embodiment, the forming apparatus includes one or more tooling stands. In one particular embodiment, the forming apparatus includes eighteen (18) tooling stands. Once in the forming apparatus, a step of forming the sheet of metal into the amplified metal stud occurs. Collectively, the one or more tooling stands may have an inverse profile, of the desired profile of the amplified metal stud, thereby forming the amplified metal stud as the sheet of metal progresses through the one or more tooling stands of the forming apparatus. An additional step includes punching the punch-outs of the amplified metal stud. In one particular embodiment, the step of punching occurs after the placing the sheet of metal into a forming apparatus and may occur after a step of removing the sheet of metal from the forming apparatus. The method also includes a step of cutting the amplified metal stud to a length. The step of cutting the amplified metal stud may be performed by transferring the sheet of metal through a shear which, at specific programmed intervals, shears the sheet of metal into individual amplified metal studs of a predetermined length. The shear may be a flying shear which travels a short duration and, for a moment, at the same speed as the sheet of metal being transferred in order to shear the sheet of metal into the individual amplified metal studs of predetermined length.

The embodiments of the amplified metal stud member discussed above will now be described in further detail below in association with the accompanying Figures.

With reference to FIG. 1, an isometric view of an amplified metal stud member 100 is illustrated. The amplified metal stud member 100 has a member length $\mathbf{100}_L$ extending an axial direction Y from a first axial end 110 to a second axial end 120. A first flange 130 and a second flange 140 extend the member length $\mathbf{100}_L$. The first flange 130 and the second flange 140 are separated by a web portion 150. A member depth $\mathbf{100}_D$ extends a lateral direction X where the first flange 130 is opposite the second flange 140 relative the member web portion 150. The member depth $\mathbf{100}_D$ is perpendicular to the member length $\mathbf{100}_L$. The first flange 130 and the second flange extend a member width $\mathbf{100}_W$. the member width $\mathbf{100}_W$ extends a widthwise direction Z. The member width $\mathbf{100}_W$ is perpendicular to the member depth $\mathbf{100}_D$ and perpendicular to the member length $\mathbf{100}_L$. The web portion 150 includes at least two bracing structures 160 and at least two stiffening structures 170. In FIG. 1, the at least two bracing structures 160 and at least two stiffening structures 170 extend the member length. The at least two bracing structures 160 have a linear surface parallel to the direction of the member depth $\mathbf{100}_D$. the at least two stiffening structures 170 have a linear surface oblique to the member depth $\mathbf{100}_D$ and member width $\mathbf{100}_W$. As illustrated by FIG. 1, the first flange 130, the second flange 140, and the web portion 150 are formed from a single metal plate.

Figure 5:
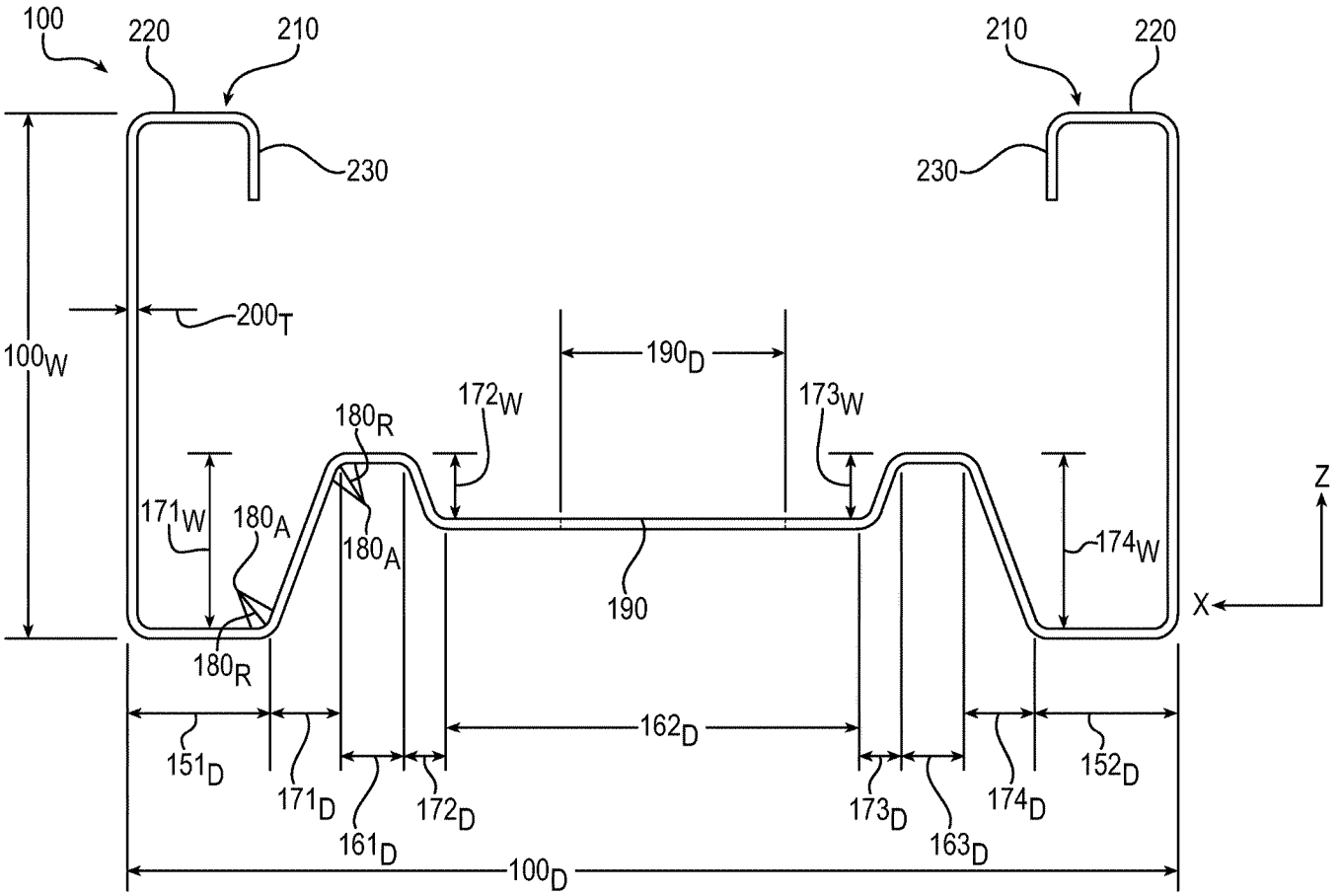
FIG. 5 is a top view of an amplified metal stud member, in accordance with an embodiment.

Still referring to FIG. 1, multiple transitioning structures 180 are illustrated. The illustrated transitioning structures 180 are a radius $\mathbf{180}_R$ (as further illustrated in FIG. 5). However, as discussed above, the transitioning structures may be angles or a variation or combination thereof. The transitioning structures 180 of FIG. 1 are a radius $\mathbf{180}_R$ with an axis $\mathbf{180}_A$ (as illustrated in FIG. 5) extending the member length $\mathbf{100}_L$. Further, the transitioning structures 180 are formed from the same single metal plate as the first flange 130, the second flange 140, and the web portion 150.

Figure 2:
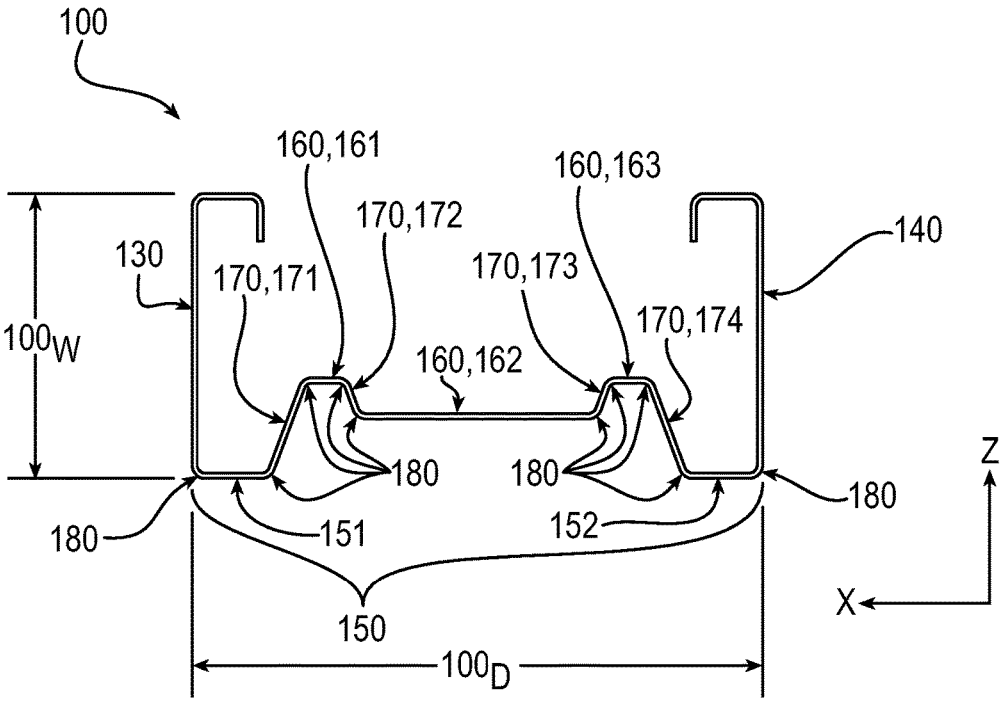
FIG. 2 is a top view of an amplified metal stud member, in accordance with an embodiment.

Turning to FIG. 2, a top view of an amplified metal stud member 100 is provided. The member depth $\mathbf{100}_D$, extending the lateral direction X, and the member width $\mathbf{100}_W$, extending the widthwise direction Z, are illustrated. The first flange 130 transitions into the web portion 150, at a first web structure 151, by a transitioning structure 180. Similarly, the second flange 140 transitions into the web portion 150, at a second web structure 152, by a transitioning structure 180. The first web structure 151 transitions into a stiffening structure 170, referred to as a first stiffening structure 171, at a radius transitioning structure 180. The stiffening structure 170 is oblique to the member depth $\mathbf{100}_D$ and oblique to the member width $\mathbf{100}_W$. The stiffening structure 170 transitions into a bracing structure 160, also referred to as a first bracing structure 161, at a radius transitioning structure 180. The bracing structures of the web portion are on a different X/Z plane than the first web structure 151 or second web structure 152 which transition into the first flange 130 or the second flange 140, respectively. Another radius transitioning structure 180 transitions a second bracing structure 160, 162 into a second stiffening structure 170, 172. Continuing the member depth $\mathbf{100}_D$, the second stiffening structure 170, 172 transitions into a third bracing structure 160, 163 at a radius transitioning structure 180. This continues through a third stiffening structure 170, 173, fourth bracing structure 160, 164, and fourth stiffening structure 170, 174 back into the web portion 150, which transitions into the second flange 140.

Figure 3:
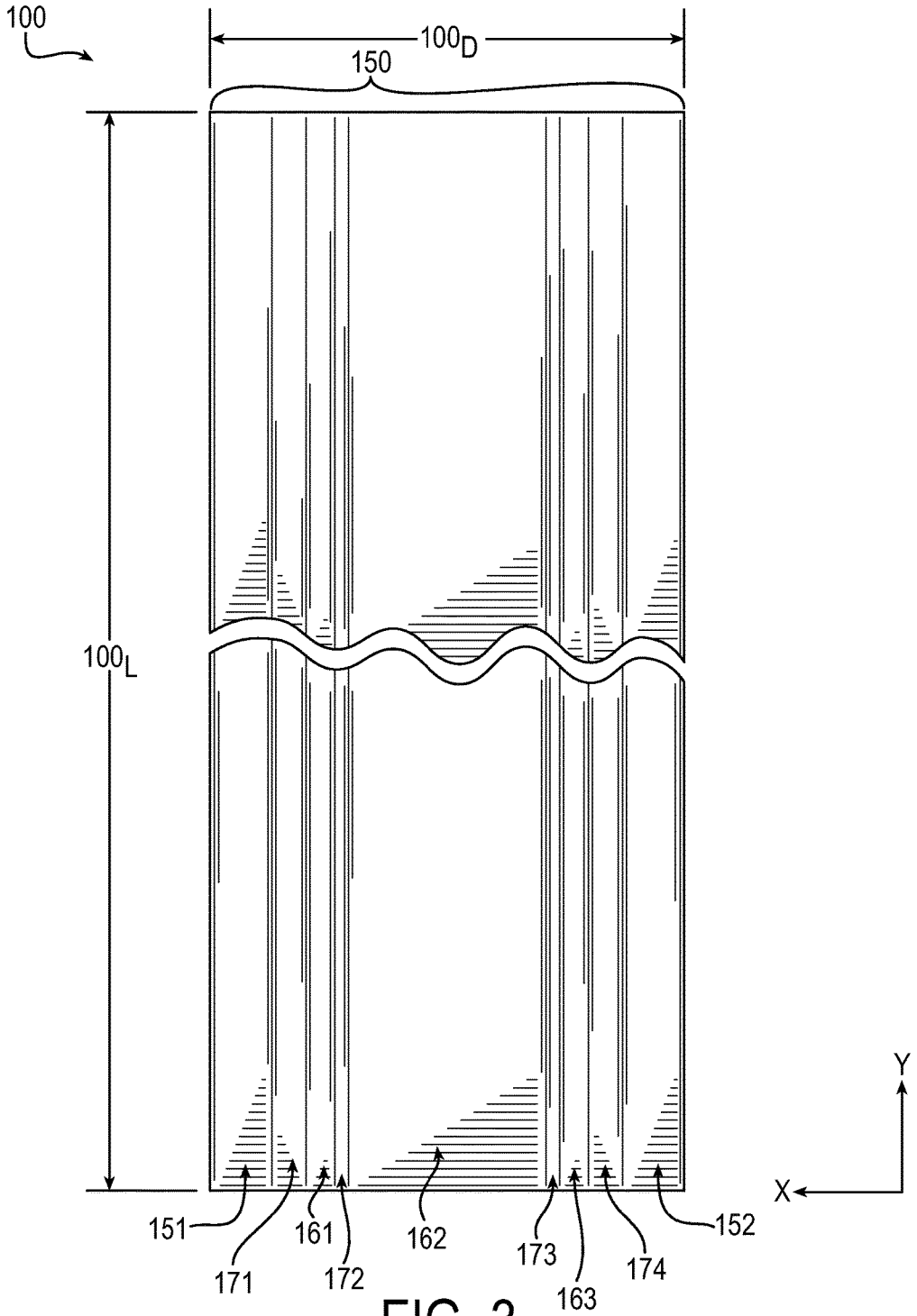
FIG. 3 is a side view of an amplified metal stud member, in accordance with an embodiment.
Figure 4:
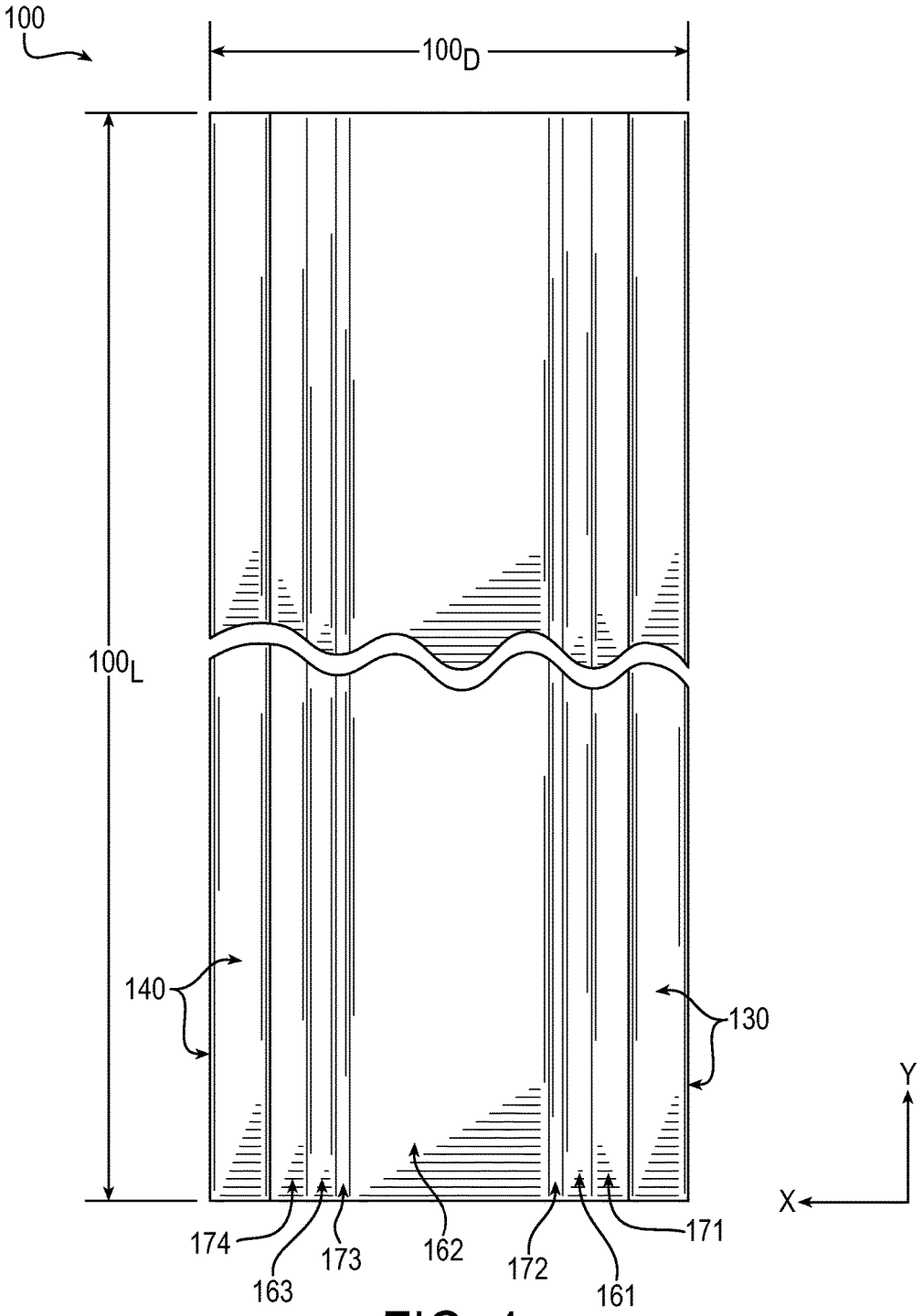
FIG. 4 is a side view of an amplified metal stud member, in accordance with an embodiment.

In FIG. 3, a side view of the web portion 150 of the amplified metal stud member 100 with a view in the direction of the member width $\mathbf{100}_W$. Each bracing structure, stiffening structure, and transitioning structure as described with respect to FIG. 2 is further illustrated in FIG. 3 relative the member length $\mathbf{100}_L$ and the member depth $\mathbf{100}_D$. Similarly, FIG. 4 illustrates a side view of the web portion 150 with a view of the first flange 130 and the second flange 140. Again, each bracing structure, stiffening structure, and transitioning structure as described with respect to FIGS. 2-3 are further illustrated in FIG. 4.

FIG. 5 illustrates one particular embodiment in greater detail. FIG. 5 includes a member depth $\mathbf{100}_D$, a member width $\mathbf{100}_W$, a first flange 130, a second flange 140, a web portion 150, bracing structures 160, stiffening structures 170, and transitioning structures 180, as illustrated in FIG. 2. In this particular embodiment the amplified metal stud member has a plate thickness $\mathbf{200}_T$. A first web portion 151, 152 extends from the outermost edge of the first flange 130 to the center of the radius $\mathbf{180}_R$ of the transitioning structure 180. A first stiffening structure 171 extends from the center of the radius $\mathbf{180}_R$ to the center of the radius $\mathbf{180}_R$ of the next transitioning structure 180. A first bracing structure 161 extends from the center of the radius $\mathbf{180}_R$ to the center of the radius $\mathbf{180}_R$ of the adjacent transitioning structure 180. A second stiffening structure 172 extends from the center of the radius $\mathbf{180}_R$ to the center of the radius $\mathbf{180}_R$ of the adjacent transitioning structure 180. A second bracing member 162 extends from the radius $\mathbf{180}_R$ to the center of the radius $\mathbf{180}_R$ of the adjacent transitioning structure 180. A third stiffening structure 173 extends from the center of the radius $\mathbf{180}_R$ to the center of the radius $\mathbf{180}_R$ of the adjacent transitioning structure 180. A third bracing member 163 extends from the radius $\mathbf{180}_R$ to the center of the radius $\mathbf{180}_R$ of the adjacent transitioning structure 180. A fourth stiffening structure 174 extends from the center of the radius $\mathbf{180}_R$ to the center of the radius $\mathbf{180}_R$ of the adjacent transitioning structure 180. A second web portion 152 extends from the center of the radius $\mathbf{180}_R$ to the outer most edge of the second flange 140. Both the first flange and the second flange extend the member width $\mathbf{100}_W$ at the outermost edge of each respective flange. The flange may further include lips 210 with a first surface 220 and a second surface 230.

In one particular embodiment, the plate thickness $\mathbf{200}_T$ is 0.0566 inches (+/−5%) or made of 16 gauge sheet steel conforming with ASTM A1003, Grade 50 material. Each transitioning structure 180 has a radius $\mathbf{180}_R$ that is 0.0849 inches (+/−5%). However, as described above, different radii and/or angles may be provided. The member depth $\mathbf{100}_D$ is 6 inches and the member width $\mathbf{100}_W$ is 3 inches. The first web portion 151 and the second web portion 152 have a web portion dimension $\mathbf{151}_D$, $\mathbf{152}_D$ of 0.800 inches. The first stiffening structure 171 and the fourth stiffening structure 174 have a stiffening structure dimension $\mathbf{171}_D$, $\mathbf{174}_D$, respectively, of 0.400 inches across the member depth $\mathbf{100}_D$ and a stiffening structure dimension $\mathbf{171}_W$, $\mathbf{174}_W$, respectively, of 1 inch across the member width $\mathbf{100}_W$. The first bracing structure 161 and the third bracing structure 163 have a bracing structure dimension, $\mathbf{161}_D$, $\mathbf{163}_D$, respectively, of 0.400 inches. The second stiffening member 172 and third stiffening member 173 have a stiffening structure dimension, $\mathbf{172}_D$, $\mathbf{173}_D$, respectively, of 0.165 inches across the member depth $\mathbf{100}_D$ and a stiffening structure dimension, $\mathbf{172}_W$, $\mathbf{173}_W$, respectively, of 0.375 inches across the member width $\mathbf{100}_W$. Finally, the second bracing structure 162 has a bracing structure dimension $\mathbf{162}_D$ of 2.470 inches. The first surface 220 of a flange lip has a depth of 0.750 inches and the second surface 230 of a flange lip has a width of 0.500 inches. In particular embodiments, the web portion 150 may include a a punch-out 190, or aperture. Punch-outs are available for providing access through an amplified metal stud for transferring items within a framing system. Examples of the items transferred through punch-outs include electric cables, data cables, and plumbing. In this particular embodiment, the punch-out 190 is centrally located within the member depth. Further, in this particular embodiment, punch-out has a aperture dimension $\mathbf{190}_D$ of 1.5 inches across the depth. The punch-out 190 is discontinuous, the member length $\mathbf{100}_L$. Unless specified otherwise, all dimensions are within a tolerance of +/−1/16 inches.

A series of stub column and web crippling tests were performed on the particular embodiment of the amplified metal stud as described in the preceding paragraph but with a uncoated sheet thickness of 0.059 inches. The tests were performed under the supervision of a Professional Engineer in the structural engineering laboratory of the Department of Civil, Architectural and Environmental Engineering on the campus of Missouri University of Science and Technology. Tensile tests performed in accordance with ASTM E370 were performed on the flat sheet material used to fabricate the test specimens. The yield stress was determined to be 49 ksi.

Stub column tests were performed with two opposing amplified metal stud members, where the lips of the flanges of each amplified metal stud member faced one another. A load was applied to the two amplified metal stud members in the axial direction. The stub column test specimens were prepared and tested in accordance with AISI S902, Stub-Column Test Method for Effective Area of Cold-Formed Steel Columns. Three identical specimens were tested. In each case the failure initiated as a local buckling in the flange of the cross-section. The ultimate load for each specimen is provided in Table X, below:

TABLE X

Stub Column Test Results

| Test Specimen | Ultimate Load (kips) |
|---|---|
| 1 | 36.14 |
| 2 | 38.83 |
| 3 | 34.23 |

Web crippling tests were performed with two opposing amplified metal stud members, where the lips of the flanges of each of each amplified metal stud member faced one another. Loads were applied to the amplified metal stud members at each flange. The web crippling test specimens were prepared and tested in accordance with AISI S909, Standard Test Method for Determining the Web Crippling Strength of Cold-Formed Steel Beams. Two identical specimens were tested. In each case the failure initiated as a vertical deflection of the profiled web of the cross-section. The ultimate applied load and the load per web for each specimen is provided in Table XI, below:

TABLE XI

Web Crippling Test Results

| Test Specimen | Ultimate Load (kips) | Load per Web (kips) |
|---|---|---|
| 1 | 3.77 | 0.943 |
| 2 | 3.89 | 0.973 |

Figure 6:
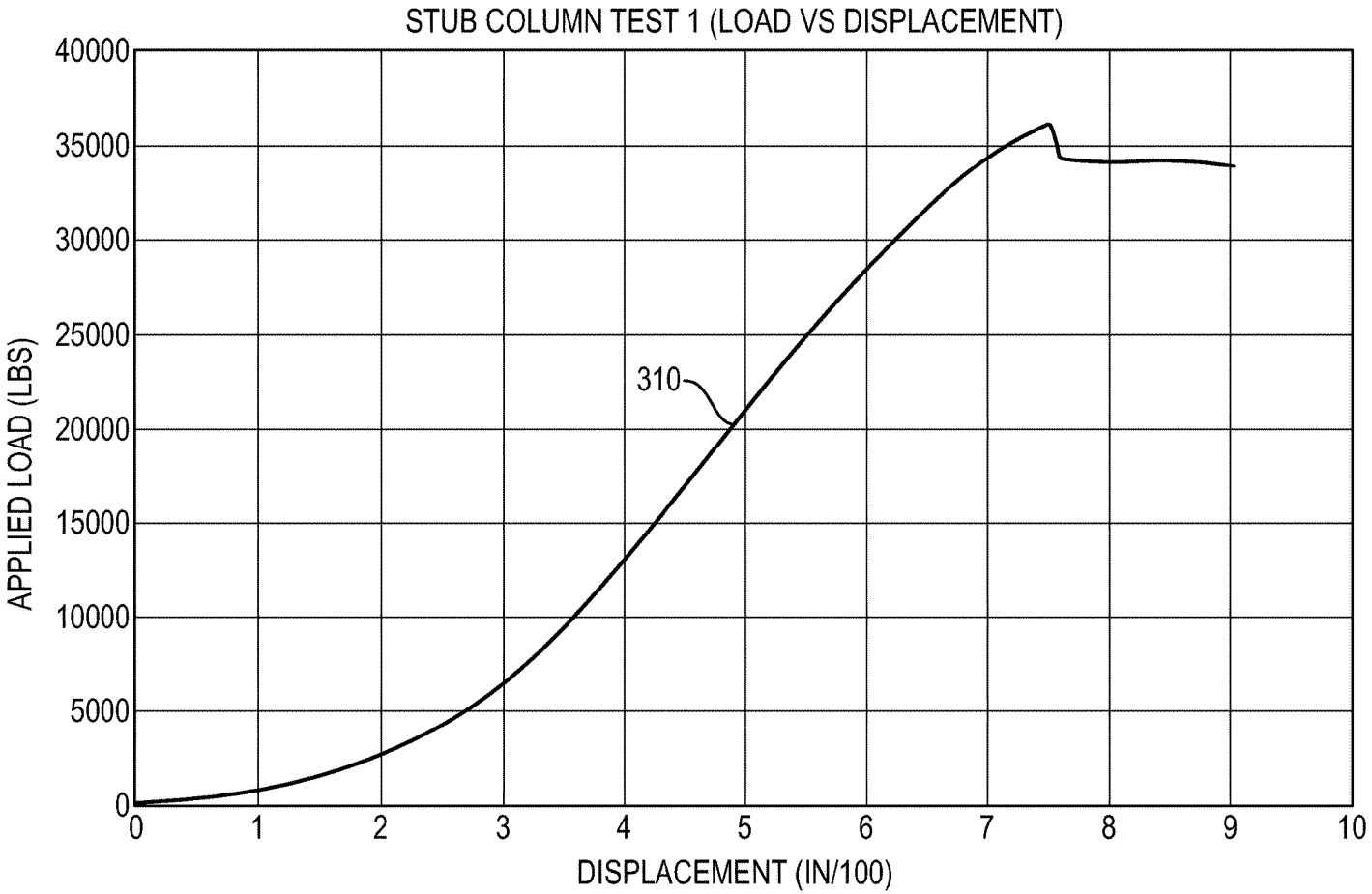
FIG. 6 is a graph of stub column test results of a test specimen, in accordance with an embodiment.
Figure 7:
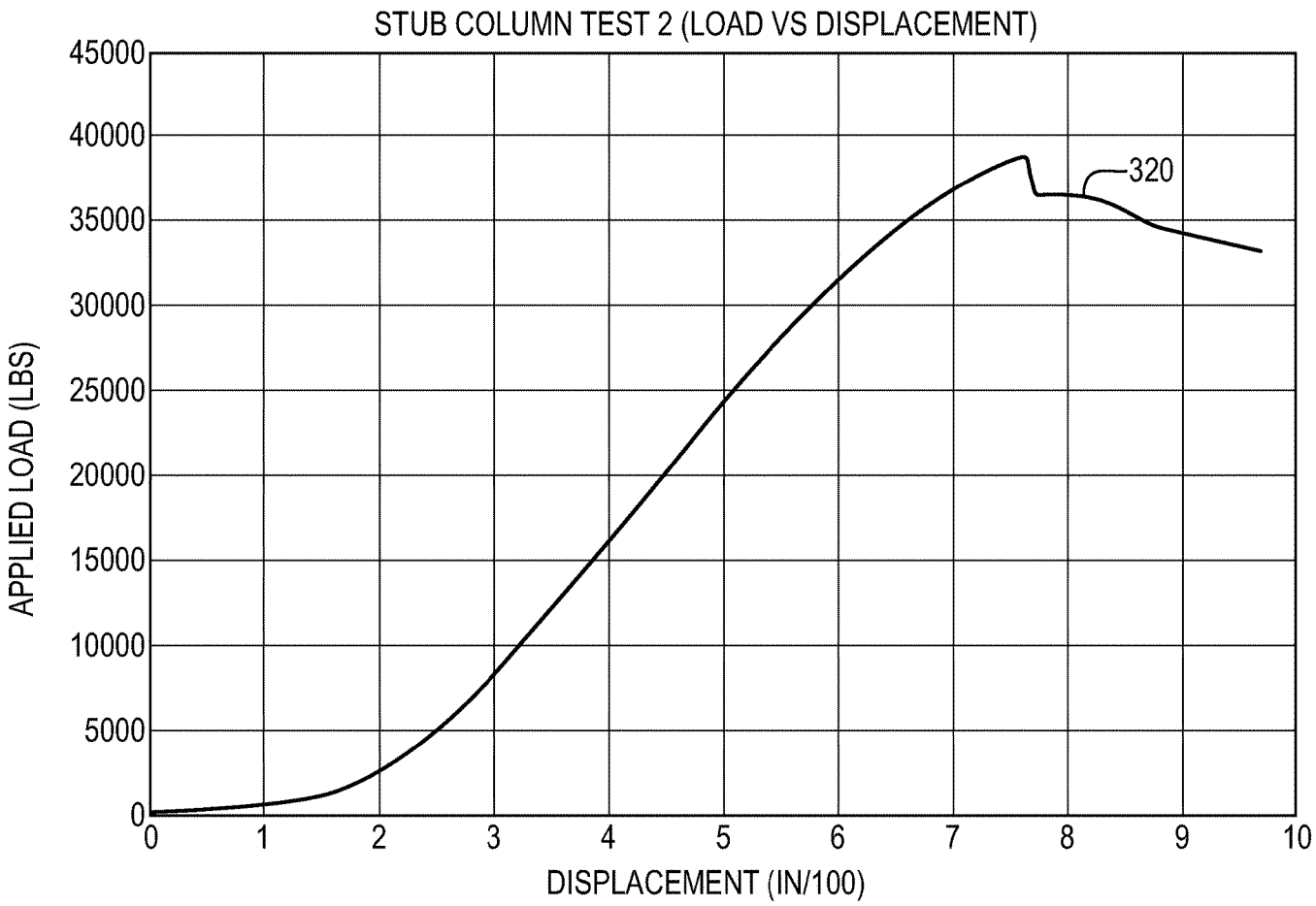
FIG. 7 is a graph of stub column test results of a test specimen, in accordance with an embodiment.
Figure 8:
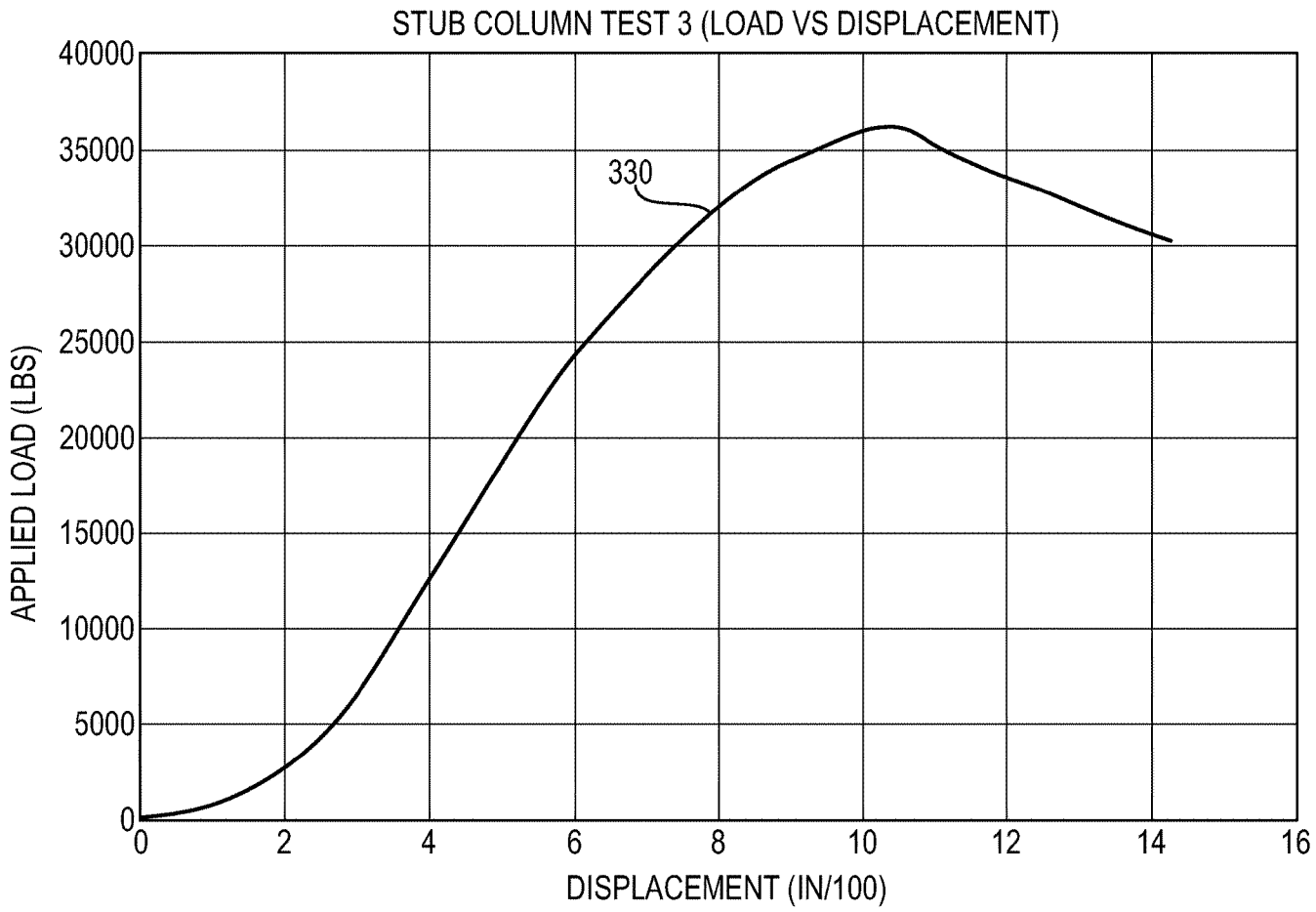
FIG. 8 is a graph of stub column test results of a test specimen, in accordance with an embodiment.
Figure 9:
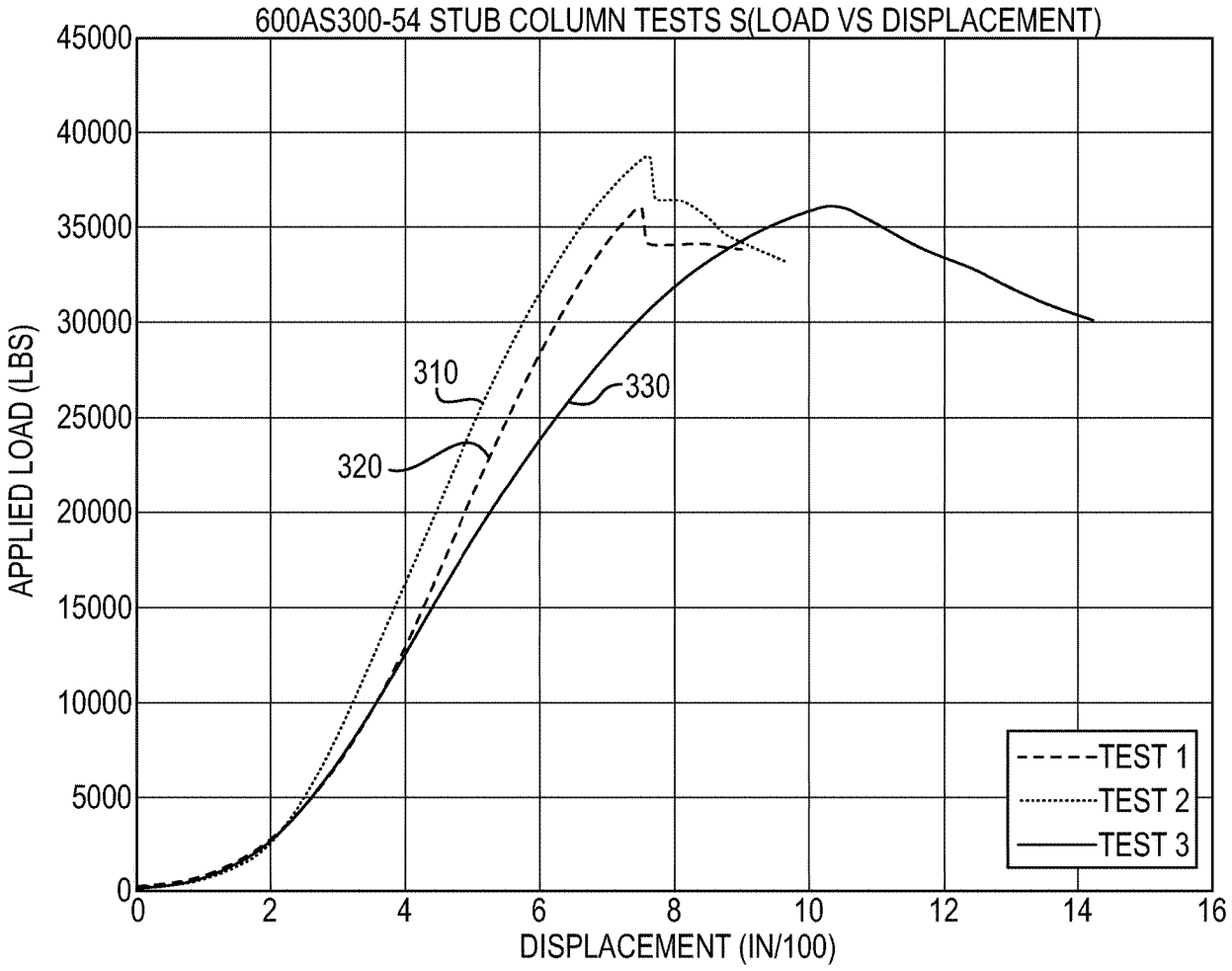
FIG. 9 is a graph of stub column test results of multiple test specimens, in accordance with an embodiment.

FIGS. 6-9 are provided to illustrate the test results for each specimen tested under the Stub Column Tests. Specifically, FIGS. 6-9 illustrate the applied load versus the displacement of the amplified metal stud members. FIG. 6 illustrates the test results for the Stub Column Test of test specimen 1 with the results labeled 310. FIG. 7 illustrates the test results for the Stub Column test of test specimen 2 with the results labeled 320. FIG. 8 illustrates the test results for the Stub Column test of test specimen 3 with the results labeled 330. Finally FIG. 9 illustrates the test results of test specimens 1 through 3 on a single graph with the results labeled 310, 320, and 330, respectively.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things are intended. The terms "preferably," "preferred," "prefer," "optionally," "may," and similar terms are used to indicate that an item, condition or step being referred to is an optional (i.e., not required) feature of the embodiments.

While this invention has been described with reference to embodiments thereof, it shall be understood that such description is by way of illustration only and should not be construed as limiting the scope of the claimed embodiments. Accordingly, the scope and content of the embodiments are to be defined only by the terms of the following claims. Furthermore, it is understood that the features of any embodiment discussed herein may be combined with one or more features of any one or more embodiments otherwise discussed or contemplated herein unless otherwise stated.

What is claimed is:

1. An amplified metal stud member comprising:

a member length extending an axial direction from a first axial end to a second axial end;

a first flange and a second flange extending the member length were the first flange and the second flange are separated by a web portion and positioned on opposing sides of a member depth, the member depth perpendicular to the member length;

the first flange and the second flange extending a member width where the member width is perpendicular to the member length and perpendicular to the member depth;

the web portion includes at least a first bracing structure, a second bracing structure, and a third bracing structure and at least a first stiffening structure, a second stiffening structure, a third stiffening structure, and a fourth stiffening structure;

the first, second, and third bracing structures each have a linear surface parallel to the member depth and the first, second, third, and fourth stiffening structures each have a linear surface oblique to the member depth and the member width;

the first and fourth stiffening structures extend a greater distance of the member width than the second and third stiffening structures; and the web portion extends in a direction of the member width at least ⅓ of the member width.

2. The amplified metal stud member of claim 1 where the first flange, the second flange, and the web portion are a single metal plate.

3. The amplified metal stud member of claim 1 where the first and second stiffening structures are separated by the first bracing structure, the second and third stiffening structures are separated by the second bracing structure, and the third and fourth stiffening structures are separated by the third bracing structure across the member depth and the first, second, and third bracing structures and the first, second, third, and fourth stiffening structures extend the member length.

4. The amplified metal stud member of claim 1 where the web portion extends to a centerline of the member width.

5. The amplified metal stud member of claim 1 where the web portion extends across a centerline of the member width.

6. The amplified metal stud member of claim 1 further comprising:

multiple transitioning structures, one of the multiple transitioning structures connects the first flange to the first stiffening structure, one of the multiple transitioning structures connects the second flange to the fourth stiffening structure, one of the multiple transitioning structures connects the first stiffening structure to the first bracing structure, and one of the multiple transitioning structures connects the fourth stiffening structure to the third bracing structure.

7. The amplified metal stud member of claim 6 where the multiple transitioning structures are a radius corner extending the member length.

8. The amplified metal stud member of claim 6 where the multiple transitioning structures are an angled corner extending the member length.

9. The amplified metal stud member of claim 1 where the first bracing structure and the third bracing structure are coplanar.

10. The amplified metal stud member of claim 1 includes at least two pair of bracing structures where each bracing structure of each pair of the at least two pair of bracing structures are coplanar.

11. The amplified metal stud member of claim 1 where the first stiffening structure and the fourth stiffening structure are inverse relative a centerline of the member depth.

12. The amplified metal stud member of claim 1 where a member shear center is proximal a member geometric centroid.

13. The amplified metal stud member of claim 1 where a member shear center is at a member geometric centroid.

14. The amplified metal stud member of claim 1 comprising a thickness of 0.059 inches or less.

15. The amplified metal stud member of claim 14 where the thickness is 0.0566 inches.

16. An amplified metal stud member comprising:

a member length extending an axial direction from a first axial end to a second axial end;

a first flange and a second flange extending the member length were the first flange and the second flange are separated by a web portion and positioned on opposing sides of a member depth, the member depth perpendicular to the member length;

the first flange and the second flange extending a member width where the member width is perpendicular to the member length and perpendicular to the member depth;

the web portion includes a first web portion extending from and perpendicular to the first flange and a second web portion extending from and perpendicular to the second flange;

a first bracing structure, a second bracing structure, and a third bracing structure where the first bracing structure is parallel to the first and second web portions and separated from the first web portion by a first stiffening structure, where the third bracing structure is parallel to the first and second web portions and separated from the second web portion by a fourth stiffening structure, and where the second bracing structure is parallel to the first and second web portions and between the first and third bracing structures and separated from the first and third bracing structures by a second stiffening structure and a third stiffening structure, respectively;

where the first and fourth structures extend a greater distance of the member width than the second and third stiffening structures; and the web portion extends in a direction of the member width at least ⅓ of the member width.

17. The amplified metal stud member of claim 16 where the first, second, third, and fourth stiffening structures are oblique to the member depth and the member width.

18. A method for forming an amplified metal stud member, the method comprising:

providing a sheet of metal in a coiled configuration;

unwinding the sheet of metal into a flat sheet; and feeding the flat sheet into a forming apparatus having one or more tooling stands;

forming the flat sheet into an amplified metal stud member having a profile including:

a member length extending an axial direction from a first axial end to a second axial end, a first flange and a second flange extending the member length where the first flange and the second flange are separated by web portion and positioned on opposing sides of a member depth, the member depth perpendicular to the member length, the first flange and the second flange extending a member width where the member width is perpendicular to the member length and perpendicular to the member depth, the web portion includes at least a first bracing structure, a second bracing structure, and a third bracing structure and at least a first stiffening structure, a second stiffening structure, a third stiffening structure, and a fourth stiffening structure, the first, second, and third bracing structures each have a linear surface parallel to the member depth and the first, second, third, and fourth stiffening structures each have a linear surface oblique to the member depth and the member width, the first and fourth stiffening structures extend a greater distance of the member width than the second and third stiffening structures, and the web portion extends in a direction of the member width at least ⅓ of the member width; and cutting the amplified metal stud member to a member length.

19. The method of claim 18 wherein the forming apparatus includes eighteen tooling stands.

20. The method of claim 18 wherein the one or more tooling stands have a collective profile and the collective profile of the one or more tooling stands is an inverse of the profile of the amplified metal stud member.

21. The amplified metal stud member of claim 1 where the web portion is symmetrical about a centerline of the member depth.

* * * * *